US005944066A

United States Patent [19]

Viard

[11] Patent Number: 5,944,066

[45] Date of Patent: Aug. 31, 1999

[54] METHOD AND APPARATUS FOR RAPIDLY INFLATING AN INFLATABLE CHAMBER IN PARTICULAR A CHAMBER OF A SUPPORT DEVICE SUCH AS A MATTRESS

[75] Inventor: Jean-Louis Viard, Grabels, France

[73] Assignee: Support Systems International Industries, Montpellier Cedex, France

[21] Appl. No.: 09/004,772

[22] Filed: Jan. 9, 1998

[30] Foreign Application Priority Data

Jan. 13, 1997 [FR] France ..... 97 00246

[51] Int. Cl.[6] ..... B65B 1/04

[52] U.S. Cl. ..... 141/1; 141/4; 141/41; 141/114; 5/713; 417/426

[58] Field of Search ..... 141/38, 5, 1, 4, 141/39, 40, 41, 67, 114; 137/223; 128/845, 846; 5/713, 714, 715; 417/62, 202, 426

[56] References Cited

U.S. PATENT DOCUMENTS 5,403,417 4/1995 Dudley et al. ..... 141/38

5,560,374 10/1996 Viard ..... 128/845

*Primary Examiner*—Henry J. Recla

*Assistant Examiner*—Timothy L. Maust

*Attorney, Agent, or Firm*—Wolf, Greenfield & Sacks, P.C.

[57] ABSTRACT

A method and apparatus for rapidly inflating an inflatable chamber. The apparatus comprises inflation means 50 for inflating an inflatable chamber 14 defined by a support device 12 for supporting a patient P. The apparatus 10 comprises at least one first inflation means 52 for performing inflation at a high flow rate and at a low pressure so as to fill the volume of said chamber 14 substantially fully at a low pressure, and a second inflation means 54 for inflating at a low flow rate but at a high pressure to obtain said predetermined inflation pressure in said chamber 14. The invention makes it possible to inflate the chamber 14 rapidly, which is particularly important in medical applications.

32 Claims, 2 Drawing Sheets

METHOD AND APPARATUS FOR RAPIDLY INFLATING AN INFLATABLE CHAMBER IN PARTICULAR A CHAMBER OF A SUPPORT DEVICE SUCH AS A MATTRESS

The invention essentially relates to a method and apparatus for rapidly inflating an inflatable chamber, in particular a chamber of a support device, such as a mattress. The invention may be particularly advantageously applied to preventing and treating complications related to long periods of being confined to bed and of being kept still, in particular bedsores.

BACKGROUND OF THE INVENTION

The prior art, and in particular the Applicant's prior document FR-A-2 718 347=EP-A-676 158, discloses a method and a device for supporting an element to be supported, in particular the body of a patient, making it possible to support the element at an essentially constant controlled penetration depth.

Unfortunately, to inflate the initially-deflated chamber, the inflation means currently used are constituted by means, such as a compressor, capable of inflating the chamber at a pressure that is high, i.e. higher than 30 mbars, and in general about 50 mbars. Such means suffer from the drawback of delivering a low flow rate, i.e. a flow rate lower than about 10 liters per minute (l/min), which gives rise to a considerable waiting time of in the range 20 minutes to 60 minutes or more before the support device becomes operational.

OBJECTS AND SUMMARY OF THE INVENTION

Therefore, a main object of the present invention is to solve the new technical problem consisting in providing a solution enabling an inflatable chamber, in particular a chamber of a support device such as a mattress, to be inflated rapidly.

Another main object of the present invention is to solve the new technical problem with a solution enabling such a chamber to be inflated rapidly in less than 10 minutes, and preferably in less than 5 minutes, and better still less than 2 minutes.

Another main object of the present invention is to solve the new technical problem consisting in providing a solution enabling an inflatable chamber of a support device to be inflated rapidly, the support device serving to support an element to be supported, in particular the body of a patient, advantageously when preventing or treating complications suffered by patients confined to bed for prolonged periods, patients who have undergone skin grafts, or patients who are suffering acute pain consequent upon certain diseases.

All of these technical problems are solved for the first time by the present invention in a manner that is simple, cheap, safe, and reliable, that is easy to implement, and that can be used industrially and medically.

Thus, in a first aspect, the present invention provides a method of rapidly inflating an inflatable chamber with an inflation fluid, said chamber having chamber with an inflation fluid, said chamber having a given inflation volume, said method consisting in inflating said chamber to a predetermined inflation pressure, wherein the inflation is performed in two steps, namely a rapid first inflation step performed at a high flow rate and at a low pressure for filling the volume of said chamber essentially fully, and a second inflation step performed at a low flow rate and at a high pressure to obtain said predetermined inflation pressure in said chamber.

In an advantageous implementation of the method of the invention, the above-mentioned chamber is part of a support device, in particular a device for supporting the body of a patient, said support device preferably comprising a mattress.

In an advantageous implementation of the method of the invention, the high flow rate serving to perform the rapid inflation in the first step is implemented at a flow rate of not less than 50 l/min, better still not less than 100 l/min, preferably greater than 200 l/min, and more preferably greater than 300 l/min.

In another advantageous implementation, the low pressure used for the rapid inflation is a pressure lower than about 20 mbars.

In another advantageous implementation of the invention, the low flow rate used for inflation in the second step is a flow rate of not more 30 l/min.

In yet another advantageous implementation of the invention, the high pressure used for inflation in the second step is a pressure not less than 20 mbars, and better still not less than 30 mbars, in particular when the predetermined inflation pressure in the chamber is about 20 mbars. It is advantageous, in the context of invention, for the high pressure for inflation in the second step to be at least about twice the desired predetermined inflation pressure in said chamber.

In yet another advantageous implementation of the invention, the total duration of the inflation, i.e. of the above-mentioned first and second inflation steps, is not more than about 10 minutes, and preferably not more than about 5 minutes.

The present invention is particularly advantageously applicable in the context of a method of supporting an element to be supported, in particular the body of a patient, the method consisting in providing at least one support device comprising at least one closed or controlled-release chamber that is flexible and inflatable, filling and emptying means and filling and emptying control means being provided for filling said chamber with a filling fluid and emptying said fluid therefrom as a function of various chosen parameters, in particular the penetration distance to which an element to be supported such as the body of a patient penetrates into the support element comprising said chamber, and/or the inflation pressure in said chamber. These parameters are well known to a person skilled in the art, and, in particular when supporting a patient, they make it possible to achieve expected performance levels as regards giving the patient preventive or other treatment, in particular when preventing or treating complications related to the patient being confined to bed or kept still for prolonged periods, in particular bedsores, and to avoid relatively high pressures on the various portions of the element to be supported, in particular the body of a patient, such pressures being harmful to the treatment and to the comfort of certain types of patient, in particular patients who have undergone skin grafts or patients who suffer acute pain consequent upon certain diseases.

In a second aspect, the present invention also provides apparatus for rapidly inflating an inflatable chamber with an inflation fluid, said chamber having a determined inflation volume, said apparatus comprising inflation means for inflating said inflatable chamber with an inflation fluid to a predetermined inflation pressure, said apparatus comprising two distinct inflation means, namely a first inflation means for performing inflation at a high flow rate and at a low pressure so as to fill the volume of said chamber substantially fully at a low pressure, and a second inflation means for inflating at a low flow rate but at a high pressure to obtain said predetermined inflation pressure in said chamber.

Advantageous embodiments of the apparatus, in particular relating to the high flow rate, to the low pressure, to the low flow rate, and to the high pressure result clearly from the above description concerning the first aspect, which description is fully applicable to the second aspect.

In a particularly advantageous embodiment of the invention, the first inflation means for inflating at a high flow rate comprises at least one turbine or miniturbine, e.g. delivering about 350 l/min at a low pressure of about 8 mbars in a currently-preferred embodiment, advantageously an air turbine or miniturbine.

In yet another particularly advantageous embodiment of the invention, the second inflation means for inflating at a low flow rate and at a high pressure comprises at least one compressor, e.g. of the vibrating diaphragm type delivering a flow rate of about 10 l/min at a pressure of about 40 mbars so as to obtain a predetermined pressure in the chamber of about 20 mbars, advantageously an air compressor.

In the context of the invention, it is preferable for the inflation fluid with which the chamber is inflated to be air, but naturally it is possible to use a liquid such as water or an aqueous solution.

By means of the invention, the chamber is rapidly inflated in the first step in an extremely short time of about 1 minute, and the pressure in the chamber is brought up to the predetermined pressure by the second inflation means, such as a compressor, in a time that is also short, i.e. approximately in the range 1 minute to 4 minutes, which results in a total time of less than 5 minutes for inflating the chamber to the predetermined pressure.

It can be understood that the invention makes it possible to solve the above-mentioned technical problems in a manner that is simple, cheap, easy to implement, and that can be used industrially and medically.

The invention also makes it possible to inflate any type of chamber rapidly, and in particular chambers in a support device, in particular a device for supporting the body of a patient.

In the context of the invention, the support device or mattress may comprise a multitude of cushions or tubes that communicate with one another, or that communicate with one another only over certain zones, thereby making it possible to define zones that are inflated to different pressures.

Furthermore, in another embodiment, the cushions or tubes may be deflated individually alternately and sequentially, in particular every other tube, one in three tubes, one in four tubes, or one in n tubes.

It can be understood that the invention is applicable to any type of inflatable chamber.

BRIEF DESCRIPTION OF THE DRAWINGS

Other objects, characteristics, and advantages of the invention appear clearly on reading the following explanatory description made with reference to a currently-preferred embodiment of the invention given merely by way of illustration, and therefore in no way limiting the scope of the invention. It should be noted that any characteristic that appears to be novel compared with any prior art is part of the invention in its general principle. Furthermore.

In the figures:

FIG. 1 is a diagrammatic view showing the principle of rapid-inflation apparatus of the present invention, in which the inflation chamber is an inflation chamber of a support element, such as an element for supporting the body of a patient, the support element then being of the mattress type; and FIG. 2 shows the inflation curve obtained with the inflation apparatus of the present invention as shown in FIG. 1, and implementing the method of inflating of the present invention.

MORE DETAILED DESCRIPTION

Figure 1:
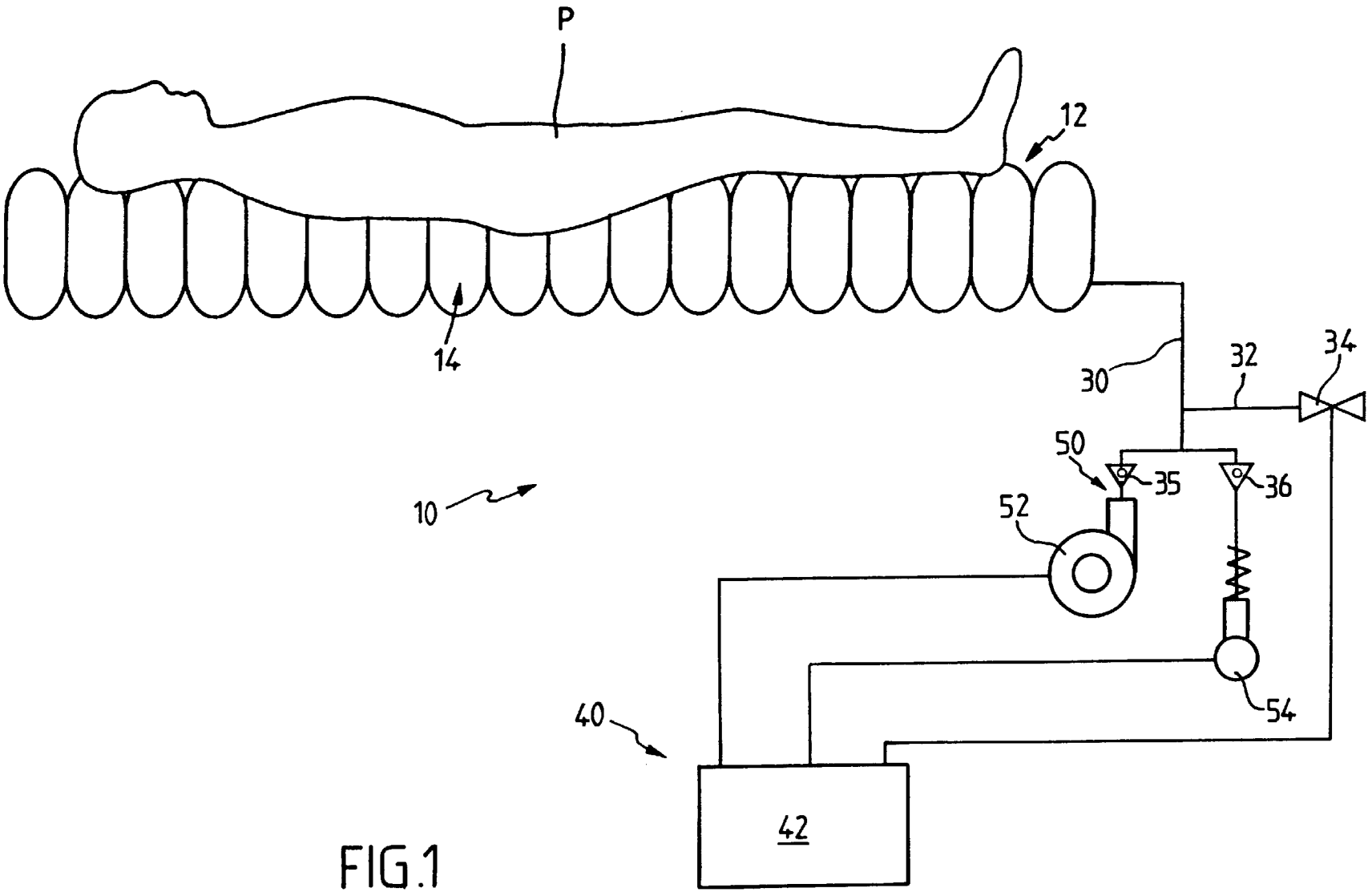
FIGS. 1 and 2 are integral parts of the present invention.

In FIG. 1, a currently-preferred embodiment of apparatus of the present invention is given the overall reference 10.

This apparatus comprises a support device proper 12, e.g. a mattress when supporting the body of a patient P. The support device may, for example, comprise at least one closed or controlled-release zone 14 that is flexible and inflatable, and that may, for example, be made up of a multitude of inflatable tubes that communicate with one another. This chamber 14 is inflatable under an initial inflation pressure that is predetermined and adjustable. The support device 12 generally rests on a base (not shown) or equivalent means.

Naturally, the support device 12 may be subdivided into a plurality of inflatable chambers, each of which can thus be inflated to an initial inflation pressure that is predetermined and different from the initial inflation pressures of the other chambers.

Advantageously, the apparatus 10 further comprises control means 40 which advantageously include a control station 42 usually comprising an electronic, electromechanical, or electro-pneumatic central processing unit for managing automatic operation of inflation of the chamber 14. Such control means 40 are well known to a person skilled in the art, and they are not described in any further detail herein. They are generally of the type of those described in the Applicant's prior document FR-A-2 718 347=EP-A-0 676 158 to which a person skilled in the art may refer.

In the context of the present invention, the apparatus 10 is constituted by apparatus for rapidly inflating an inflatable chamber (the chamber 14 in this example) with an inflation fluid such as water or air, the chamber having an inflation volume determined in the inflated state, e.g. 210 liters. The apparatus comprises inflation means 50 for inflating the inflatable chamber 14 with the inflation fluid to a predetermined inflation pressure.

In the context of the present invention, the apparatus 10 comprises at least two distinct inflation means, namely a first inflation means 52 that inflates at a high flow rate and at a low pressure for inflating the volume of the chamber substantially fully at a low pressure, and a second inflation means 54 that inflates at a low flow rate and at a high pressure to obtain the predetermined inflation pressure in the chamber 14.

In an advantageous embodiment, the first inflation means 52 for inflating at a high flow rate comprises a turbine or a miniturbine as shown, e.g. delivering about 350 l/min at a low pressure of about 8 mbars in a currently-preferred embodiment.

In another particularly advantageous embodiment of the invention, the second inflation means 54 for inflating at a low flow rate and at a high pressure comprises at least one compressor, as shown, e.g. of the vibrating diaphragm type, delivering a flow rate of about 10 l/min at a pressure of about 40 mbars when the predetermined pressure in the chamber is about 20 mbars. Naturally, the inflation means 50 are connected to the chamber 14 via a suitable pipe 30 which is provided with non-return valves 35 and 36, and from which a pipe 32 branches off on which emptying means 34 such as a valve are provided enabling the inflation fluid to be emptied when a low pressure is desired in the chamber 14. The inflation means 50, in particular the first means 52 and the second means 54, as well as the emptying means 34 are connected electronically, electro-mechanically, or electro-pneumatically to the control station 42 of the control means 40.

Particular variant implementations and embodiments concerning the method and the apparatus of the present invention result from the above description and are therefore not reproduced herein. However, in the context of the invention, it is preferable to use air as the inflation fluid, which facilitates implementation and makes it possible to dump the inflation fluid directly into the atmosphere.

It can be understood that, by means of the invention, it is possible to inflate the chamber 14 rapidly and fully to a predetermined inflation pressure in a very short time, which can be less than 5 minutes, unlike the prior art solutions in which inflation generally takes in the range 20 minutes to 60 minutes or more.

Figure 2:
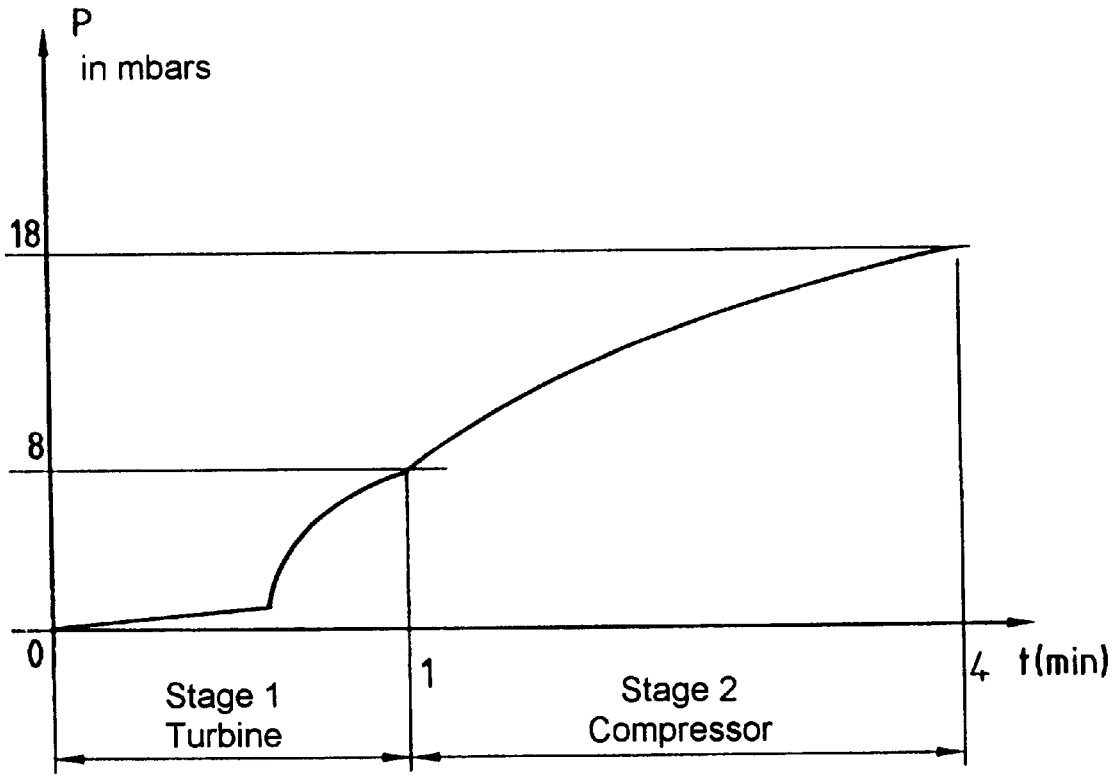

FIG. 2 shows an inflation curve obtained by using apparatus of the invention as described with reference to FIG. 1 to inflate a chamber 14 of a support device 12 suitable for supporting a patient P, the first inflation means of said apparatus being constituted by a miniturbine delivering a high flow rate of air of about 350 l/min at a low pressure of about 8 mbars, and the second inflation means of said apparatus being constituted by a booster pump of the annular turbine type delivering a low flow rate of about 10 l/min at a high pressure of about 40 mbars. Using this apparatus, it is possible to fill the volume of 210 liters of the chamber 14 to a pressure of about 18 mbars in 4 minutes, which constitutes a decisive technical advantage compared with the prior art.

Naturally, the invention covers any means constituting technical equivalents of the means described, and the various combinations thereof.

I claim:

1. A method of rapidly inflating an inflatable chamber of a mattress of a device for supporting the body of a patient, with an inflation fluid, said chamber having a given inflation volume, said method comprising inflating said chamber to a predetermined inflation pressure, wherein the inflation is performed in two steps, namely a rapid first inflation step performed at a high flow rate and at a low pressure filling the volume of said chamber essentially fully, and a second inflation step performed at a low flow rate and at a high pressure to obtain said predetermined inflation pressure in said chamber.

2. The method of claim 1, wherein the chamber is part of a support device.

3. The method of claim 1, wherein the low pressure used for the rapid inflation is a pressure lower than about 20 mbars.

4. The method of claim 1, wherein the low flow rate used for inflation in the second step is a flow rate of not more than 30 l/min.

5. The method of claim 1, wherein the high pressure used for inflation in the second step is a pressure not less than 20 mbars.

6. The method of claim 1, wherein the high pressure used for inflation in the second step is a pressure not less than 30 mbars, when the predetermined inflation pressure in the chamber is about 20 mbars.

7. The method of claim 1, wherein the total duration of the inflation, comprising the first and second inflation steps, is not more than about 10 minutes.

8. The method of claim 1, wherein the total duration of the inflation, comprising the first and second inflation steps, is not more than about 5 minutes.

9. The method of claim 1, wherein the high flow rate serving to perform the rapid inflation in the first step is implemented at a flow rate of not less than 50 l/min.

10. The method of claim 9, wherein the flow rate is not less than 100 l/min.

11. The method of claim 10, wherein the flow rate is greater than 200 l/min.

12. The method of claim 11, wherein the flow rate is greater than 300 l/min.

13. A method of supporting a body of a patient, said method comprising providing at least one support device or mattress for supporting the patient body, said support device or mattress comprising at least one closed or controlled-release chamber that is flexible and inflatable, filling and emptying means and filling and emptying control means for filling said chamber with a filling fluid and emptying said fluid therefrom as a function of various chosen parameters, including either the penetration distance to which the body of a patient penetrates into the support device or mattress comprising said chamber or the inflation pressure in said chamber said chamber having a given inflation volume, said method comprising inflating said chamber to a predetermined inflation pressure wherein the inflation is performed in two steps, namely a rapid first inflation step performed at a high flow rate and at a low pressure for filling the volume of said chamber essentially fully, and a second inflation step performed at a low flow rate and at a high pressure to obtain said predetermined inflation pressure in said chamber.

14. The method of claim 13, wherein the low pressure in the first step is lower than about 20 mbars.

15. The method of claim 13, wherein the low flow rate in the second step is not more than 30 l/min.

16. The method of claim 13, wherein the high pressure in the second step is not less than 20 mbars.

17. The method of claim 13, wherein the high pressure in the second step is not less than 30 mbars, when the predetermined inflation pressure in the chamber is about 20 mbars.

18. The method of claim 13, wherein the total duration of the first and second inflation steps is not more than about 10 minutes.

19. The method of claim 13, wherein the total duration of the first and second inflation steps, is not more than about 5 minutes.

20. The method of claim 13, wherein the high flow rate in the first step is not less than 50 l/min.

21. The method of claim 20, wherein the high flow rate is not less than 100 l/min.

22. The method of claim 21, wherein the high flow rate is greater than 200 l/min.

23. The method of claim 22, wherein the high flow rate is greater than 300 l/min.

24. An apparatus for supporting the body of a patient, comprising at least one support device or mattress for supporting said patient body, said support device or mattress comprising at least one closed or controlled-released chamber that is flexible and inflatable, filling and emptying apparatus and filling and emptying control apparatus for filling said chamber with a filling fluid and for emptying said fluid from said chamber as a function of various chosen parameters including either the penetration distance to which the body of the patient penetrates into the support device or mattress, or the inflation pressure in said chamber, said fluid filling apparatus comprising inflation apparatus for inflating said inflatable chamber with an inflation fluid to a predetermined inflation pressure, said inflation apparatus comprising two distinct inflation devices, namely a first inflation device for performing inflation at a high flow rate and at a low pressure to fill the volume of said chamber substantially fully at a low pressure, and a second inflation device for inflating at a low flow rate but at a high pressure to obtain said predetermined inflation pressure in said chamber.

25. The apparatus of claim 24, wherein the second inflation device for inflating at a low flow rate and at a high pressure comprises at least one compressor.

26. The apparatus of claim 25, wherein said compressor is an air compressor.

27. The apparatus of claim 24, wherein the first inflation device for inflating at a high flow rate comprises at least one turbine or miniturbine.

28. The apparatus of claim 27, wherein said turbine or miniturbine is an air turbine or miniturbine.

29. An apparatus for rapidly inflating an inflatable chamber with an inflation fluid, said chamber having a determined inflation volume, said apparatus comprising inflation means for inflating said inflatable chamber with an inflation fluid to a predetermined inflation pressure, said apparatus comprising two distinct inflation means, namely a first inflation means comprising at least one turbine or miniturbine for performing inflation at a high flow rate and at a low pressure so as to fill the volume of said chamber substantially fully at a low pressure, and a second inflation means for inflating at a low flow rate but at a high pressure to obtain said predetermined inflation pressure in said chamber.

30. The apparatus of claim 29, wherein said turbine or miniturbine is an air turbine or miniturbine.

31. The apparatus of claim 15, wherein the second inflation means for inflating at a low flow rate and at a high pressure comprises at least one compressor.

32. The apparatus of claim 31, wherein said compressor is an air compressor.

* * * * *